US005769212A

United States Patent [19]

Collins

[11] Patent Number: 5,769,212

[45] Date of Patent: Jun. 23, 1998

[54] AUTOMOTIVE ALARM SYSTEM REMOTE CONTROL KEYPAD POUCH

[76] Inventor: La Vella Collins, 3753 S. Plaza Trail, Virginia Beach, Va. 23452

[21] Appl. No.: 797,210

[22] Filed: Feb. 11, 1997

[51] Int. Cl.[6] ..... A45C 11/32

[52] U.S. Cl. ..... 206/38; 206/37

[58] Field of Search ..... 208/38, 38.1, 37, 208/37.1, 37.4, 37.8, 39

[56] References Cited

U.S. PATENT DOCUMENTS 1,821,585 9/1931 Smith ..... 206/38.1

3,613,416 10/1971 Paton ..... 206/37.1 X 4,166,489 9/1979 Lemelson ..... 206/38.1

4,934,528 6/1990 Miller et al. ..... 206/37.1 X

*Primary Examiner*—Jacob K. Ackun

[57] ABSTRACT

A pouch with a key ring for an automotive alarm system remote control keypad is provide herein and comprises a pouch formed of heavy weight fabric as that used in automobile interiors and flexible enough to allow the mechanics of the keypad to be itilized without removing the keypad from the pouch,with a closable opening and adapted to receive a remote control keypad, also having a ring adapted to hold keys attached by lacing the ring through the stitched sleeve above the flap to which that portion of the Velcro fastener is attached to secure the keypad inside the pouch.

1 Claim, 1 Drawing Sheet

AUTOMOTIVE ALARM SYSTEM REMOTE CONTROL KEYPAD POUCH

BACKGROUND OF THE INVENTION

People who purchase automotive alarm systems are provided with a remote control keypad made of one piece molded plastic, a hole in in the plastic structure allows a short metal chain to be attached to it for the purpose of accomodating a key ring.

After a short period of use and more frequently that portion to which the chain is attached breaks away from the body of the keypad rendering the keypad unattachable to a keyring.

While the body of the keypad is still functional, the ability to conveniently utilize it for the purpose of its intent is severely deminished and the time gained through the convenience of the remote control mechanism is lost when the keypad has to be retreived from a clothing pocket. Further, the keypad must be replaced at a costly fee or carried on one's person, the latter proving even more costly when the keypad is lost.

There are a variety of pouches available in the arts, created usually for holding coins or other devices but none are specifically created or designed to accomodate an automotive alarm system remote control keypad.

BRIEF SUMMARY OF THE INVENTION

A primary object of this invention is to provide a pouch with a key ring specifically for an automotive alarm system remote control keypad that will address the need in the absence of such among the prior arts devices.

Another object is to provide a pouch with a key ring for an automotive alarm system remote control keypad that will restore the keypad's usefullness in the matter of time and convenience.

Another object is to provide a pouch with a key ring for an automotive alarm system remote control keypad that will allow both the keypad and automobile keys to be kept in close proximity of each at all times Another object is to provide a pouch with a key ring for an automotive alarm remote control keypad that is simple, easy to use, economically cost effective to manufacture and similarily to provide an alternative to the costly replacement fee.

Finally. an object is to provide a pouch with a key ring made of heavy weight , durable fabric that will allow the keypad mechanism to be utilized by touch without having to remove the keypad from the pouch.

This invention relates to a small pouch constructed of heavy weight durable fabric with a Velcro fastener attached to the flap and body for closure and a metal split key ring laced through the stitched sleeve at the top of the pouch, specifically addressing the needs of an automotive alarm system remote keypad.

DETAILED DESCRIPTION OF THE INVENTION

Figure 3:
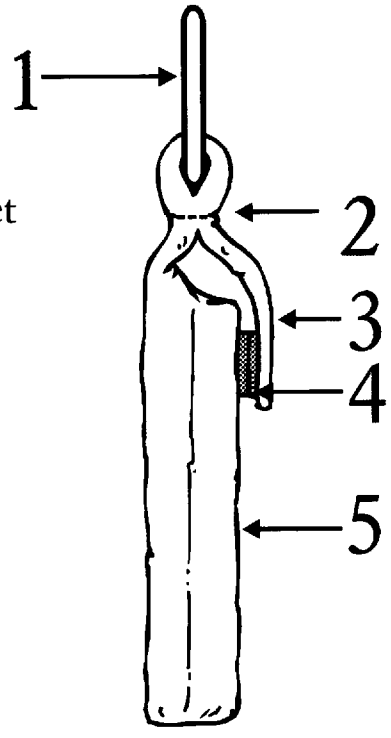
FIG. 3 is a side view displaying the flap in closed position, the key ring laced through the stitched sleeve.

The embodiment shown in the drawings include a pouch 5 having a closable opening with a flap 3 and adapted to receive a remote control keypad, a one inch metal split key ring 1 adapted to hold keys and attached to the pouch 5 by lacing the one inch metal split key ring 1 through the stitched sleeve 2, the pouch 5 is constructed of a heavy weight durable fabric flexible enough to allow the mechanism of the keypad to be utilized without removing the keypad from the pouch 5.

Figure 2:
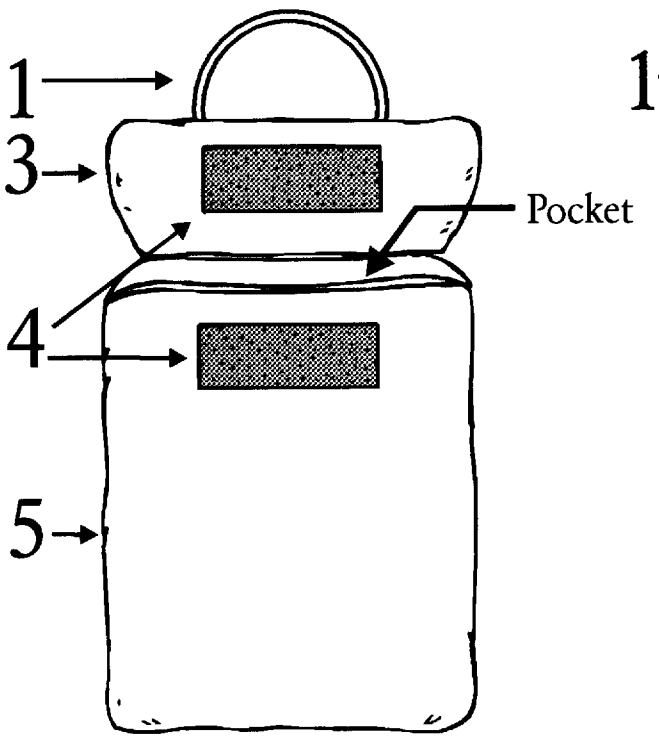
FIG. 2 is a front view displaying the flap in opened position, the pocket and Velcro fastener.
Figure 1:
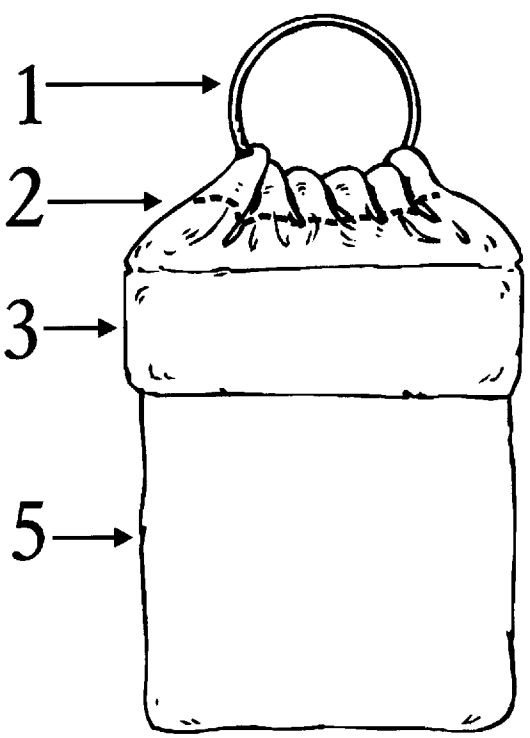
FIG. 1 is a front view of the invention with closed flap, displaying the stitched sleeve and key ring.

Refering to FIG. 2, the pouch 5 is constructed of a heavy weight durable fabric such as upholstery cloth or flexible vinyl as used in automobile seat interior seat coverings.

A length of upholstery cloth is generally of rectangular shape and is formed into the pouch 5 by folding it back on itself and stitching along the right and left edges to form a pocket and reversing the fabric to conceal the seams.

The other end of the fabric is folded and stitched to form flap 3 the fabric is further stitched across the top above the flap 3 to form a sleeve 2 to receive the one inch metal split key ring 1, before folding and stitching the body of the pouch 5 , other operations are carried out as follows:

One such operation is stitching each end length-wise of the fabric to prevent fraying, the end that formulates the body of the pouch 5 then has that portion of the Velcro fastener 4 stitched to the outer side of the body of the pouch 5, the other end formulating the flap 3 has that portion of the Velcro fastener 4 stitched to the underside of said flap 3.

Having stitched that portion of the fabric to formulate the body of the pouch 5 creating a pocket, with the Velcro fastener 4 attached to the body of the pouch 5 and the flap 3, the stitched sleeve 2 is laced with the one inch metal split key ring 1.

This invention has the unique feature of allowing the mechanics of the keypad to be utilized without having to remove the keypad, it keeps the keys in close proximity and addresses the need for a pouch specifically to accomodate an automotive alarm system remote control keypad not otherwise found in the arts.

While there has been shown and described a preferred embodiment of the pouch of this invention, it is understood that changes in fabric and shape can be made by those skilled in the arts without departing from the invention.

Having described the invention the following claims can be made.

I claim:

1. A device for supporting an object, said device comprising a pouch adapted to accommodate and support therein an automotive alarm system remote keypad, said pouch being constructed of a heavy weight durable material which is flexible enough to facilitate actuation of mechanisms of said keypad without removal of the keypad from the pouch, said material selected from one of the group consisting of flexible sheet plastic and fabric, said pouch being formed from a rectangular length of said material which is folded back on itself and stitched along right and left edges thereof to form a pocket having a closed end and an open end, an extension of said length of said material at said open end being folded and stitched to form a flap to close said open end and a sleeve disposed across the top of said flap, a key ring attached to said sleeve to accommodate automobile keys thereon.

* * * * *